United States Patent [19]

Nakamura et al.

[11] Patent Number: 4,491,550

[45] Date of Patent: Jan. 1, 1985

[54] VARIABLE VENTURI TYPE CARBURETOR

[75] Inventors: Norihiko Nakamura; Takaaki Itoh, both of Mishima; Toshiharu Morino, Mie, all of Japan

[73] Assignees: Toyota Jidosha Kogyo Kabushiki Kaisha; Aisan Industry Co. Ltd., both of Japan

[21] Appl. No.: 618,326

[22] Filed: Jun. 8, 1984

Related U.S. Application Data

[63] Continuation of Ser. No. 426,832, Sep. 29, 1982, abandoned.

[30] Foreign Application Priority Data

Feb. 5, 1982 [JP] Japan ..... 57-16334

[51] Int. Cl.[3] ..... F02M 9/06

[52] U.S. Cl. ..... 261/44 C

[58] Field of Search ..... 261/44 C, 44 B

[56] References Cited

U.S. PATENT DOCUMENTS

| | | | |
|---|---|---|---|
| 4,013,741 | 3/1977 | Edmonston | 261/44 B |
| 4,185,054 | 1/1980 | Nakamura et al. | 261/44 C |
| 4,276,238 | 6/1981 | Yoshikawa et al. | 261/44 C |
| 4,302,404 | 11/1981 | Nakamura et al. | 261/44 C |
| 4,302,405 | 11/1981 | Inoue et al. | 261/44 C |
| 4,371,478 | 2/1981 | Wada | 261/44 C |

*Primary Examiner*—Tim Miles

*Attorney, Agent, or Firm*—Finnegan, Henderson, Farabow, Garrett & Dunner

[57] ABSTRACT

A variable venturi-type carburetor comprising a suction piston which has a tip face defining a venturi portion. The tip face has a flat upstream end portion. A raised wall is formed on the inner wall of an intake passage, which faces the tip face of the suction piston. The raised wall has a tip edge having an approximately V-shaped cross-section. The flat upstream end portion of the tip face of the suction piston cooperates with the tip edge of the raised wall for defining an approximately isosceles triangular-shaped air inlet control opening therebetween when the amount of air fed into the cylinder of an engine is small.

2 Claims, 2 Drawing Figures

VARIABLE VENTURI TYPE CARBURETOR

This application is a continuation of application Ser. No. 06/426,832, filed Sept. 29, 1982, now abandoned.

BACKGROUND OF THE INVENTION

The present invention relates to a variable venturi-type carburetor.

The inventor has proposed a variable venturi-type carburetor having a raised wall which projects from the inner wall of the intake passage, which inner wall faces the tip face of the suction piston serving to change the cross-sectional area of the venturi portion of the carburetor in response to a change in the amount of air fed into the cylinder of the engine. In this carburetor, the raised wall has a substantially straight extending tip edge, and the upstream end portion of the tip face of the suction piston is shaped in a V-shaped cross-section which expands toward the venturi portion so that an approximately triangular-shaped air inflow opening is formed between the tip edge of the raised wall and the upstream end portion of the tip face of the suction piston when the amount of air fed into the cylinder of the engine is small. In this carburetor, when the amount of air fed into the cylinder of the engine is small, since the opening area of the air inflow opening is smoothly increased in accordance with the increase in the lift of the suction piston, the amount of air fed into the cylinder of the engine is not abruptly changed and, therefore, it is possible to prevent the output power of the engine from abruptly changing. However, in this carburetor, since the raised wall projects into the intake passage to a great extent, the flow area of the intake passage is small even if the suction piston maximally opens the intake passage and, as a result, a problem occurs in that the volumetric efficiency will be reduced when the amount of air fed into the cylinder of the engine is large.

SUMMARY OF THE INVENTION

An object of the present invention is to provide a variable venturi-type carburetor capable of obtaining a high volumetric efficiency when the amount of air fed into the cylinder of the engine is large, by forming the raised wall so that the flow area of the intake passage becomes large as compared with a prior carburetor when the suction piston maximally opens the intake passage.

According to the present invention, there is provided a variable venturi-type carburetor comprising: an axially-extending intake passage formed in the carburetor and having an inner wall; a suction piston transversely movable in said intake passage in response to a change in the amount of air flowing within said intake passage, said suction piston having a tip face which defines a venturi portion in said intake passage and has a flat upstream end portion; a nozzle arranged on the inner wall of said intake passage, which faces the tip face of said suction piston; a needle fixed onto the tip face of said suction piston and extending through said nozzle; and a raised wall projecting from the inner wall of said intake passage, which faces the tip face of said suction piston, and having a tip edge which has an approximately V-shaped cross-section expanding toward said intake passage and cooperates with the flat upstream end portion of the tip face of said suction piston for defining an approximately isosceles triangular-shaped air inlet control opening between the flat upstream end portion of the tip face of said suction piston and the tip edge of said raised wall when the amount of air flowing within said intake passage is small.

The present invention may be more fully understood from the description of a preferred embodiment of the invention set forth below, together with the accompanying drawings.

DESCRIPTION OF A PREFERRED EMBODIMENT

Figure 1:
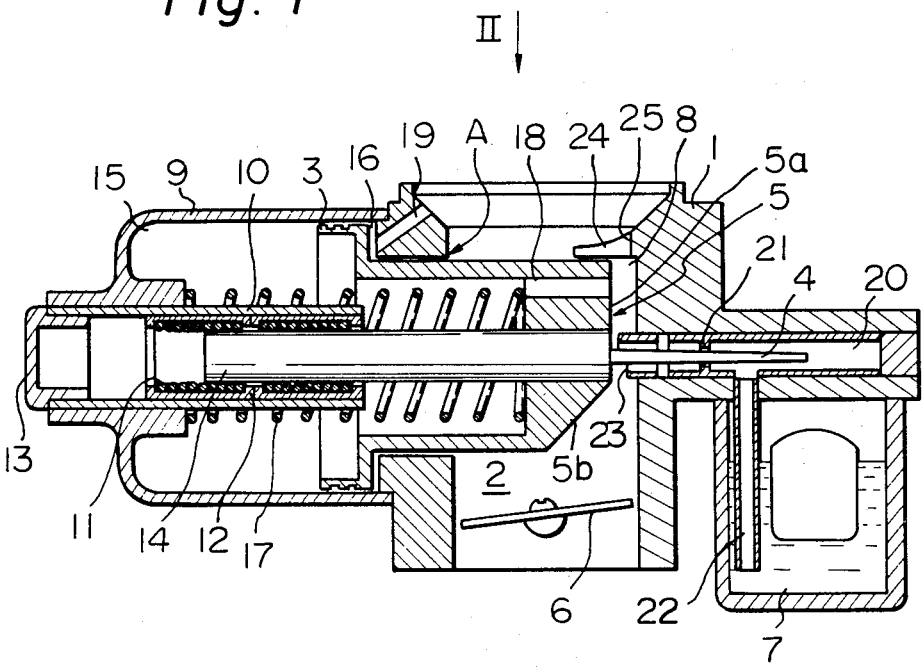
FIG. 1 is a cross-sectional side view of a variable venturi-type carburetor according to the present invention.

Referring to FIG. 1, 1 designates a carburetor body, 2 a vertically-extending intake passage, 3 a suction piston transversely movable in the intake passage 2, and 4 a needle fixed onto the suction piston 3; 5 designates a tip face of the suction piston 3, 6 a throttle valve arranged in the intake passage 2 located downstream of the suction piston 3, and 7 a float chamber of the carburetor. The tip face 5 of the suction piston 3 comprises a flat portion 5*a* located upstream of the needle 4 and an inclined portion 5*b* located downstream of the needle 4 and directed downwards. A venturi portion 8 is formed between the flat portion 5*a* of the suction piston 3 and the inner wall of the intake passage 2, which faces the flat portion 5*a* of the suction piston 3.

A hollow cylindrical casing 9 is fixed onto the carburetor body 1, and a guide sleeve 10, extending within the casing 9 in the axial direction of the casing 9, is attached to the casing 9. A bearing 12, equipped with a plurality of balls 11, is inserted into the guide sleeve 10, and the outer end of the guide sleeve 10 is closed with a blind cap 13. Guide rod 14 is fixed onto the suction piston 3 and is inserted into the bearing 12 so as to be movable in the axial direction of the guide rod 14. Since the suction piston 3 is supported by the casing 9 via the bearing 12 as mentioned above, the suction piston 3 is able to move smoothly in the axial direction thereof. The interior of the casing 9 is divided into a vacuum chamber 15 and an atmospheric pressure chamber 16 by the suction piston 3, and a compression spring 17 for continuously biasing the suction piston 3 toward the venturi portion 8 is inserted into the vacuum chamber 15. The vacuum chamber 15 is connected to the venturi portion 8 via a suction hole 18 formed in the suction piston 3, and the atmospheric pressure chamber 16 is connected to the intake passage 2 located upstream of the suction piston 3 via an air hole 19 formed in the carburetor body 1.

Fuel passage 20 is formed in the carburetor body 1 and extends in the axial direction of the needle 4 so that the needle 4 can enter into the fuel passage 20. A metering jet 21 is arranged in the fuel passage 20. The fuel passage 20, located upstream of the metering jet 21, is connected to the float chamber 7 via a downwardly-extending fuel pipe 22, and fuel in the float chamber 7 is fed into the fuel passage 20 via the fuel pipe 22. In addition, a hollow cylindrical nozzle 23, arranged coaxially to the fuel passage 20, is fixed onto the inner wall of the intake passage 2. The nozzle 23 projects from the inner wall of the intake passage 2 into the venturi portion 8 and, in addition, the upper half of the tip portion of the nozzle 23 projects from the lower half of the tip portion of the nozzle 23 toward the suction piston 3. The needle 4 extends through the interior of the nozzle 23 and the metering jet 21, and fuel is fed into the intake passage 2 from the nozzle 23 after it is metered by an annular gap formed between the needle 4 and the metering jet 21.

Figure 2:
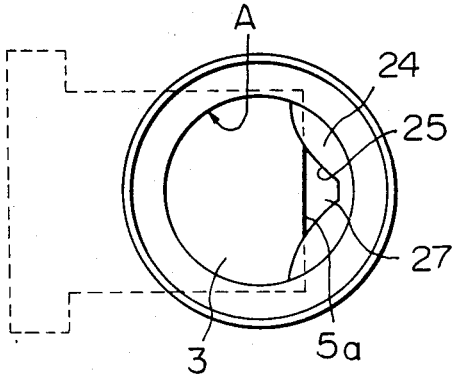
FIG. 2 is a plan view taken along the arrow II in FIG. 1.

As illustrated in FIGS. 1 and 2, a raised wall 24, projecting horizontally into the intake passage 2, is formed on the inner wall of the intake passage 2, which faces the tip face 5 of the suction piston 3. The raised wall 24 has a tip edge 25 having a V-shape cross-section which expands toward the intake passage 2. Consequently, when the amount of air fed into the cylinder of the engine is small, an approximately isosceles triangular-shaped air inflow control opening 27 is formed between the tip edge 25 of the raised wall 24 and the upstream end of the flat portion 5*a* of the tip face of the suction piston 3, as illustrated in FIG. 2. When the engine is started, air flows downward within the intake passage 2. At this time, since the air flow is restricted in the air inflow control opening 27 formed between the suction piston 3 and the raised portion 24, a vacuum is created in the venturi 8. This vacuum acts on the vacuum chamber 15 via the suction hole 18. The suction piston 3 moves so that the pressure difference between the vacuum in the vacuum chamber 15 and the pressure in the atmospheric pressure chamber 16 becomes approximately equal to a fixed value determined by the spring force of the compression spring 17, that is, the level of the vacuum created in the venturi portion 8 remains approximately constant.

According to the present invention, since the air inflow control opening 27 has an approximately isosceles triangular-shape when the amount of air fed into the cylinder of the engine is small, the area of the air inflow control opening 27 is smoothly changed when the suction piston 3 moves. Consequently, it is possible to prevent the output power of the engine from abruptly changing. In addition, since the tip edge 25 of the raised wall 24 has a V-shape, the cross-sectional area of an air inlet mouth A (FIG. 2) formed between the tip edge 25 of the raised wall 24 and the inner wall of the intake passage 2 becomes large as compared with a prior carburetor and, thus, it is possible to obtain a high volumetric efficiency when the amount of air fed into the cylinder of the engine is large.

While the invention has been described with reference to a specific embodiment chosen for purposes of illustration, it should be apparent that numerous modifications could be made thereto by those skilled in the art without departing from the basic concept and scope of the invention.

We claim:

1. A variable venturi-type carburetor comprising:

an axially-extending intake passage formed in the carburetor and having an inner wall and a circular cross section;

a suction piston tranversely movable in said intake passage in response to a change in the amount of air flowing within said intake passage, said suction piston having a tip face which defines a venturi portion in said intake passage and has a flat upstream end portion, the tip face of said suction piston being fully retracted from said intake passage to preclude obstruction of said intake passage when said air flow is large;

a nozzle arranged on the inner wall of said intake passage opposite the tip face of said suction piston;

a needle fixed onto the tip face of said suction piston and extending through said nozzle; and a raised wall projecting from the inner wall of said intake passage opposite the tip face of said suction piston and being disposed immediately upstream of and adjacent to the upstream end of said suction piston, said raised wall having a tip edge which has an approximately V-shaped cross section expanding toward said intake passage and being disposed for overlapping relationship with the flat upstream end portion of the tip face of said suction piston for defining an approximately isosceles triangular-shaped air inlet control opening between the flat upstream end portion of the tip face of said suction piston and the tip edge of said raised wall when the amount of air flowing within said intake passage is small.

2. A variable venturi-type carburetor according to claim 1, wherein the tip face of said suction piston comprises a flat portion located upstream of said nozzle and an inclined portion located downstream of said nozzle.

* * * * *